US008292213B2

(12) United States Patent
Kobayashi et al.

(10) Patent No.: US 8,292,213 B2
(45) Date of Patent: Oct. 23, 2012

(54) TRANSPORT DEVICE FOR TRANSPORTING ROLL-SHAPED RECORDING MEDIUM AND RECORDING APPARATUS

(75) Inventors: Masaki Kobayashi, Suwa (JP); Kiyoto Komuro, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 403 days.

(21) Appl. No.: 12/404,975

(22) Filed: Mar. 16, 2009

(65) Prior Publication Data

US 2009/0242603 A1 Oct. 1, 2009

(30) Foreign Application Priority Data

Mar. 25, 2008 (JP) ..... 2008-078950

(51) Int. Cl.
*B65H 16/06* (2006.01)

(52) U.S. Cl. ..... 242/599.4; 242/596.4

(58) Field of Classification Search ..... 242/596.1, 242/596.4, 596.7, 871.4, 571.5, 599, 599.4, 242/596.5, 596.6; 400/242, 613
See application file for complete search history.

(56) References Cited

U.S. PATENT DOCUMENTS

| | | | | |
|---|---|---|---|---|
| 6,425,548 | B2 * | 7/2002 | Christensen et al. | 242/571.4 |
| 6,491,252 | B2 * | 12/2002 | Komatsu et al. | 242/596.1 |
| 6,877,920 | B2 * | 4/2005 | Fujioka | 400/613 |
| 6,910,655 | B2 * | 6/2005 | Fujioka | 242/545.1 |
| 7,429,013 | B2 * | 9/2008 | Ward | 242/578.1 |
| 2001/0042810 | A1 * | 11/2001 | Christensen et al. | 242/597.2 |
| 2003/0080238 | A1 * | 5/2003 | Seybold et al. | 242/611.2 |
| 2003/0127555 | A1 * | 7/2003 | Squires | 242/597.6 |
| 2006/0147243 | A1 * | 7/2006 | Blanchard et al. | 400/613 |

FOREIGN PATENT DOCUMENTS

| | | |
|---|---|---|
| JP | 06-009116 A | 1/1994 |
| JP | 2007-245544 | 9/2007 |
| JP | 2007-245545 | 9/2007 |
| JP | 2007-261754 | 10/2007 |
| JP | 2008-019057 | 1/2008 |

* cited by examiner

*Primary Examiner* — William A Rivera
(74) *Attorney, Agent, or Firm* — Maschoff Gilmore & Israelsen

(57) ABSTRACT

A transport device for transporting a roll-shaped recording medium includes: a pair of roll retainers that are attached to both sides of a roll portion of the roll-shaped recording medium; a pair of spindles that are engaged with the roll retainers to support the roll portion; a transport roller that transports the roll-shaped recording medium drawn out from the roll portion while pinching the roll-shaped recording medium; and a positioning mechanism that rotates the roll portion supported by the spindles in a direction in which tension is applied to the drawn roll-shaped recording medium to move the roll portion to one side in a longitudinal direction such that a reference edge of the roll-shaped recording medium comes into contact with a reference position, thereby positioning the reference edge of the roll-shaped recording medium.

6 Claims, 14 Drawing Sheets

TRANSPORT DEVICE FOR TRANSPORTING ROLL-SHAPED RECORDING MEDIUM AND RECORDING APPARATUS

BACKGROUND

1. Technical Field

The present invention relates to a transport device for transporting a roll-shaped recording medium having a function of positioning the roll-shaped recording medium and a recording apparatus.

2. Related Art

Hereinafter, an ink jet printer, which is an example of a recording apparatus, will be described. Among the ink jet printers, there is a large ink jet printer capable of ejecting ink onto a recording medium having a large size, such as an A1+ (extension) size or a B0+ (extension) size, to perform recording. The large ink jet printer generally uses roll-shaped recording media having a roll width of 24 inches (about 610 mm), 36 inches (about 914 mm), or 44 inches (about 1118 mm), and a roll length of 10 m to 45 m. In addition, various kinds of roll-shaped recording media have been used. For example, roll-shaped recording media made of different materials, such as paper or a film, roll-shaped recording media having high rigidity, such as resin-coated photo paper, and roll-shaped recording media having low rigidity, such as plain paper, have been used.

In the ink jet printer, a printer body is provided with a roll holder that sets a roll-shaped recording medium (hereinafter, referred to as a roll sheet). In the related art, a plurality of roll shafts having different lengths are used to correspond to the roll widths of roll sheets. The roll shaft is inserted into a roll core of the roll sheet and then the roll sheet is set to the roll holder. However, the operation of setting the roll sheet needs to ensure a large working space, or the setting operation becomes complicated. In addition, when a long roll shaft is used, the roll shaft is likely to be bent, which causes the roll sheet to be obliquely transported.

Therefore, JP-A-2007-261754 discloses a device for supporting a roll-shaped recording medium. In the device for supporting a roll-shaped recording medium, flange members, serving as roll retainers, are attached to both sides of the roll-shaped recording medium. Then, first, a driven flange member is mounted to a second holder member that is disposed on the driven side of the roll holder and can be rotated in a roll width direction. Then, the second holder member is moved together with the roll sheet to a first holder member that is disposed on the driving side of the roll holder to mount the driving flange member attached to the roll sheet to the first driving holder member, thereby setting the roll sheet to the roll holder.

According to the device for supporting a roll-shaped recording medium having the above-mentioned structure, the problems of the related art, such as a large working space, a complicated setting operation, and the oblique transport of a roll sheet due to the bending of a roll shaft, are solved.

However, when the roll sheet set to the second holder member is moved to be set to the first holder member, it is difficult to sufficiently move the roll sheet and backlash is likely to occur between the driving flange member and the first holder member. When the roll sheet is drawn while the backlash occurs, the position of the reference edge of the roll sheet is not determined, and an image is not recorded at a desired position on the roll sheet.

SUMMARY

An advantage of some aspects of the invention is that it provides a transport device for transporting a roll-shaped recording medium capable of performing a general operation to automatically dispose the reference edge of the roll-shaped recording medium at a regular reference position, for example, during the drawing of the roll-shaped recording medium, even when the set position of a roll portion of the roll-shaped recording medium is insufficient, and a recording apparatus including the transport device for transporting a roll-shaped recording medium.

According to a first aspect of the invention, there is provided a transport device for transporting a roll-shaped recording medium. The transport device includes: a pair of roll retainers that are attached to both sides of a roll portion of the roll-shaped recording medium; a pair of spindles that are engaged with the roll retainers to support the roll portion; a transport roller that transports the roll-shaped recording medium drawn out from the roll portion while pinching the roll-shaped recording medium; and a positioning mechanism that rotates the roll portion supported by the spindles in a direction in which tension is applied to the drawn roll-shaped recording medium to move the roll portion to one side in a longitudinal direction such that a reference edge of the roll-shaped recording medium comes into contact with a reference position, thereby positioning the reference edge of the roll-shaped recording medium.

According to the above-mentioned aspect, even when the set position of the roll portion of the roll-shaped recording medium is insufficient, it is possible to perform a general operation to automatically dispose the reference edge of the roll-shaped recording medium at a regular reference position, for example, during the drawing of the roll-shaped recording medium.

According to a second aspect of the invention, there is provided a transport device for transporting a roll-shaped recording medium. The transport device includes: a driving roll retainer and a driven roll retainer that are attached to both sides of a roll portion of the roll-shaped recording medium; a driving spindle and a driven spindle that are engaged with the driving roll retainer and the driven roll retainer to support the roll portion; a driving supporting mechanism and a driven supporting mechanism that support the driving spindle and the driven spindle; a spindle driving source that rotates the driving spindle forward and backward; a moving mechanism that moves the driven supporting mechanism toward the driving supporting mechanism such that the driving spindle and the driven spindle support the roll portion; a transport roller that transports the roll-shaped recording medium drawn out from the roll portion while pinching the roll-shaped recording medium; and a positioning mechanism that positions a reference edge of the roll-shaped recording medium by operating the transport roller or the spindle driving source or drawing out the roll-shaped recording medium from the roll portion to rotate the roll portion supported by the driving spindle and the driven spindle in a direction in which tension is applied to the drawn roll-shaped recording medium, thereby moving the roll portion to the driving spindle such that the reference edge of the roll-shaped recording medium comes into contact with a reference position.

According to the above-mentioned aspect, any of the following general operations are performed before recording: an operation of moving the driven supporting mechanism to the driving supporting mechanism to support the roll portion with the driving spindle and the driven spindle, drawing the start point of the roll-shaped recording medium from the roll portion, and transporting the recording medium using the transport roller; and an operation of rotating the spindle in the winding direction to apply tension to the roll-shaped recording medium between the transport roller and the roll portion.

Therefore, the set position of the roll portion of the roll-shaped recording medium is automatically corrected, and it is possible to move the reference edge of the roll-shaped recording medium to the regular reference position.

According to a third aspect, the transport device for transporting a roll-shaped recording medium according to the first or second aspect may further include: engaging portions that are provided in the driving spindle and the driven spindle; and engaged portions that are provided in the driving roll retainer and the driven roll retainer and are engaged with the engaging portions of the driving and driven spindles such that power can be transmitted. The positioning mechanism may be a cam structure that is provided between the engaged portion of the driving roll retainer and the engaging portion of the driving spindle.

According to the above-mentioned aspect, since the positioning mechanism is a cam structure that is provided between the engaged portion of the driving roll retainer and the engaging portion of the driving spindle, the driving roll retainer is moved toward the driving spindle to be set to the driving spindle. In this way, a cam structure is obtained. That is, it is possible to reduce the number of parts of the positioning mechanism and simplify the structure of the positioning mechanism.

According to a fourth aspect of the invention, in the transport device for transporting a roll-shaped recording medium according to the third aspect, the cam structure may have a cam including a cam follower that is formed on an inner circumferential surface of the driving roll retainer so as to extend inward and a cam groove that is formed in an outer circumferential surface of the engaging portion. The cam groove may include: a guide portion that guides the cam follower into the cam groove; a drawing portion that draws the cam follower into the cam groove such that the reference edge of the roll-shaped recording medium reaches the reference position when the roll portion is rotated in the direction in which tension is applied; and a straight portion that enables the cam follower to be withdrawn from the cam groove when the roll portion is rotated in a direction in which the tension is removed.

According to the above-mentioned aspect, it is possible to form a cam structure using the existing engaging structure that is provided between the engaged portion of the driving roll retainer and the engaging portion of the driving spindle in order to transmit the rotation of the spindle driving source to the roll portion of the roll-shaped recording medium. The guide portion, the drawing portion, and the straight portion provided in the cam groove make it possible to perform an operation of smoothly inserting the cam follower into the cam groove, an operation of correcting the set position of the roll portion (moving the roll portion to the regular reference position) and holding the set position, and an operation of smoothly withdrawing the cam follower from the cam groove.

The transport device for transporting a roll-shaped recording medium according to any one of the first to fourth aspects may further include: a tension generating unit that generates a constant tension to the roll-shaped recording medium between the transport roller and the roll portion regardless of a variation in the roll diameter of the roll portion.

According to the above-mentioned aspect, even when the roll diameter of the roll portion varies, the set tension of the roll-shaped recording medium between the transport roller and the roll portion is maintained to be constant. Therefore, it is possible to improve the transport accuracy of a roll-shaped recording medium. As a result, it is possible to move the reference edge of the roll-shaped recording medium to the regular reference position and improve recording quality.

According to a sixth aspect of the invention, a recording apparatus includes: the roll-shaped recording medium transport device according to any one of the first to fifth aspects that transports a roll-shaped recording medium to a recording position while drawing out the roll-shaped recording medium; and a recording device that ejects ink onto a recording surface of the roll-shaped recording medium transported to the recording position to perform desired recording.

According to the above-mentioned aspect, a general operation is performed to automatically correct the set position of a roll-shaped recording medium before recording, thereby moving the reference edge of the roll-shaped recording medium to the regular reference position. In addition, the set tension of the roll-shaped recording medium between the transport roller and the roll portion is maintained to be constant, regardless of a variation in the roll diameter of the roll portion. Therefore, it is possible to improve the positional accuracy of the roll-shaped recording medium in the roll width direction and the transport accuracy thereof. As a result, it is possible to improve recording quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a transport device for transporting a roll-shaped recording medium and a recording apparatus including the transport device for transporting a roll-shaped recording medium according to an embodiment of the invention will be described. First, the outline of the overall structure of an ink jet printer 100, which is an example of the recording apparatus according to the embodiment of the invention, will be described. The ink jet printer 100 according to this embodiment is a large ink jet printer that can perform recording on a recording surface of a large sheet-shaped recording medium (hereinafter, referred to as a cut sheet) having, for example, an A3+ (extension) size or more or a large roll-shaped recording medium (hereinafter, referred to as a roll sheet) P having, for example, an A1+ (extension) size or a B0+ (extension) size.

Figure 1:
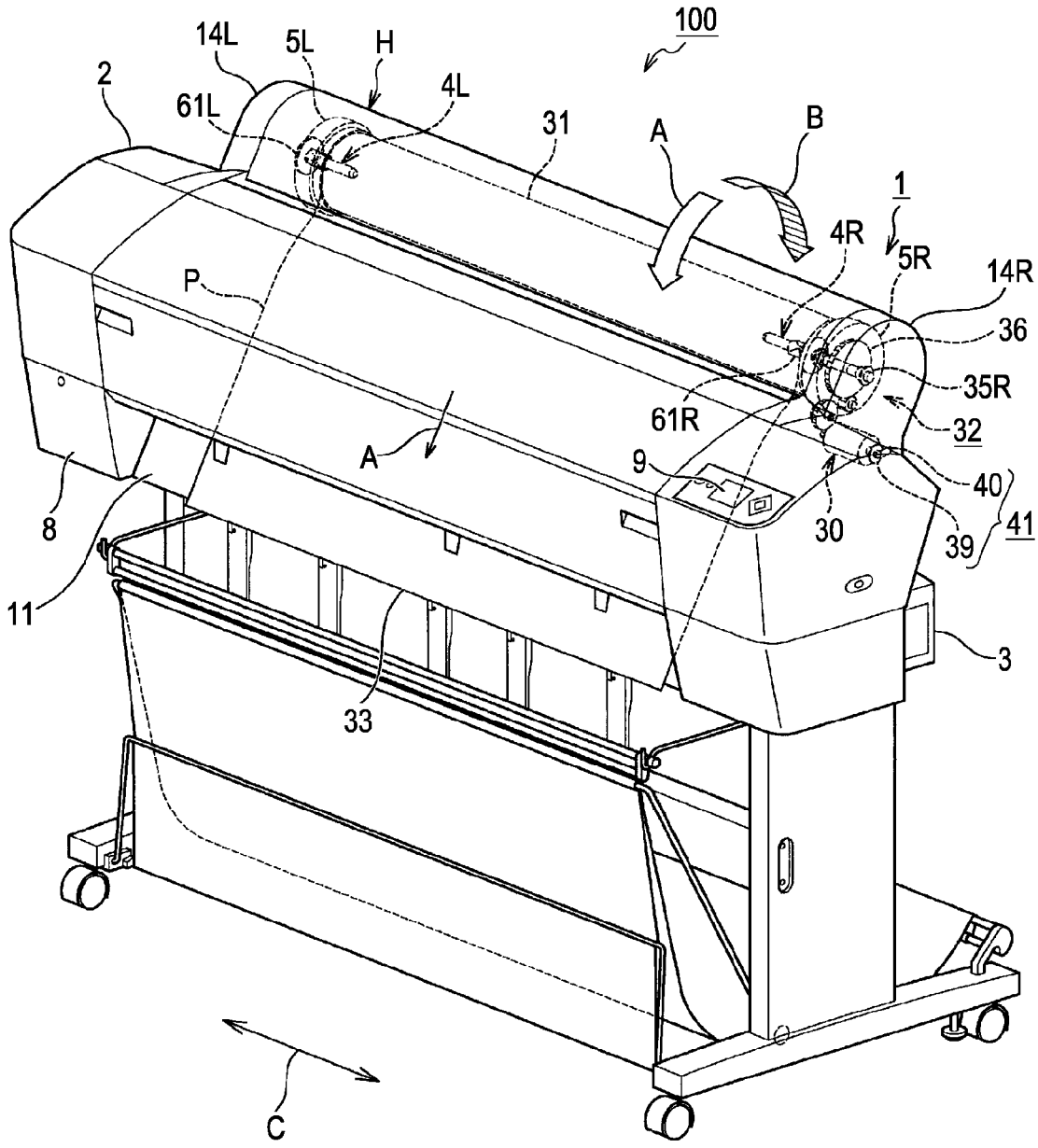
FIG. 1 is a perspective view illustrating the outward appearance of an ink jet printer.
Figure 2:
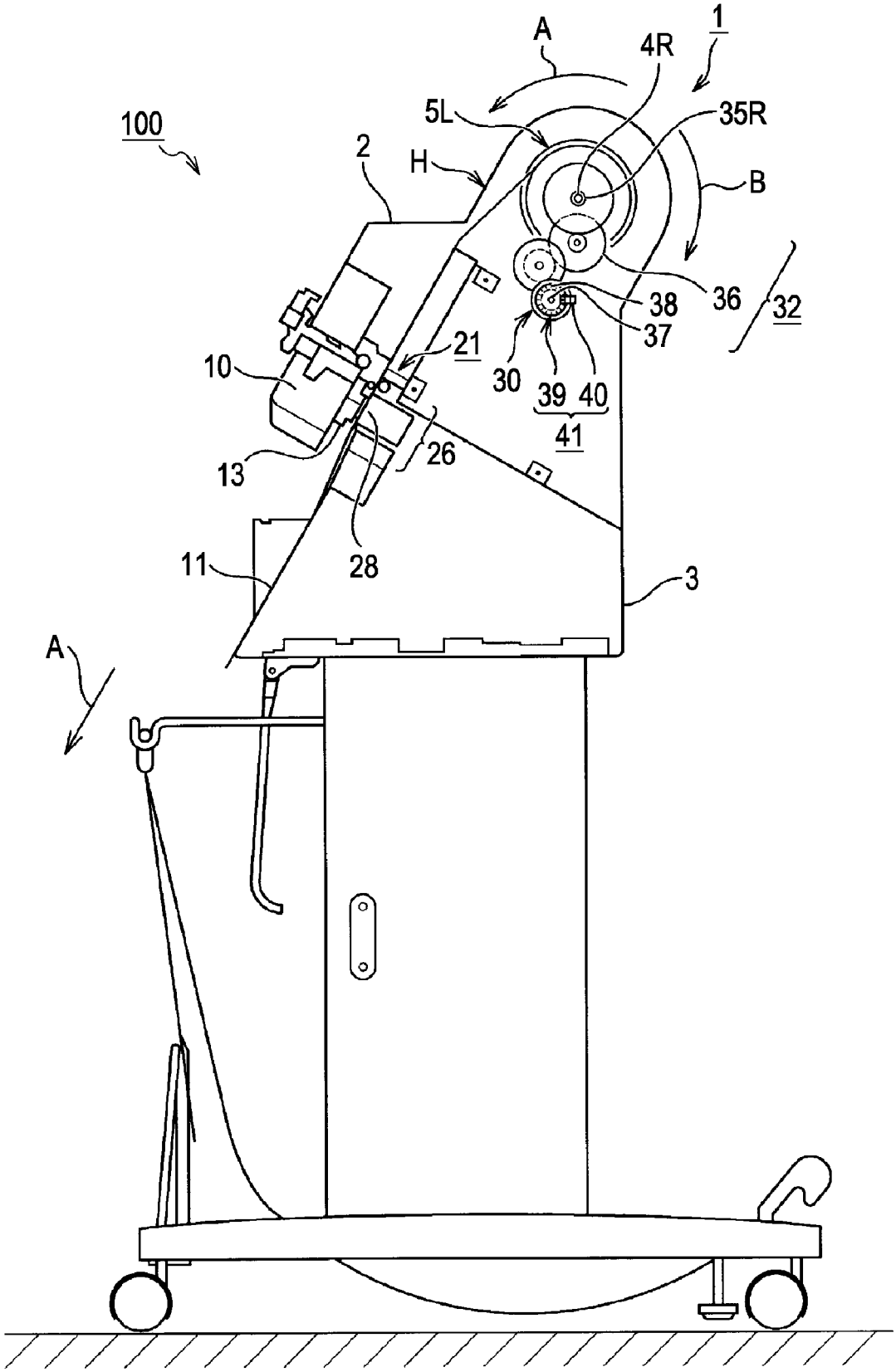
FIG. 2 is a side cross-sectional view illustrating the ink jet printer from which a body cover is removed.
Figure 3:
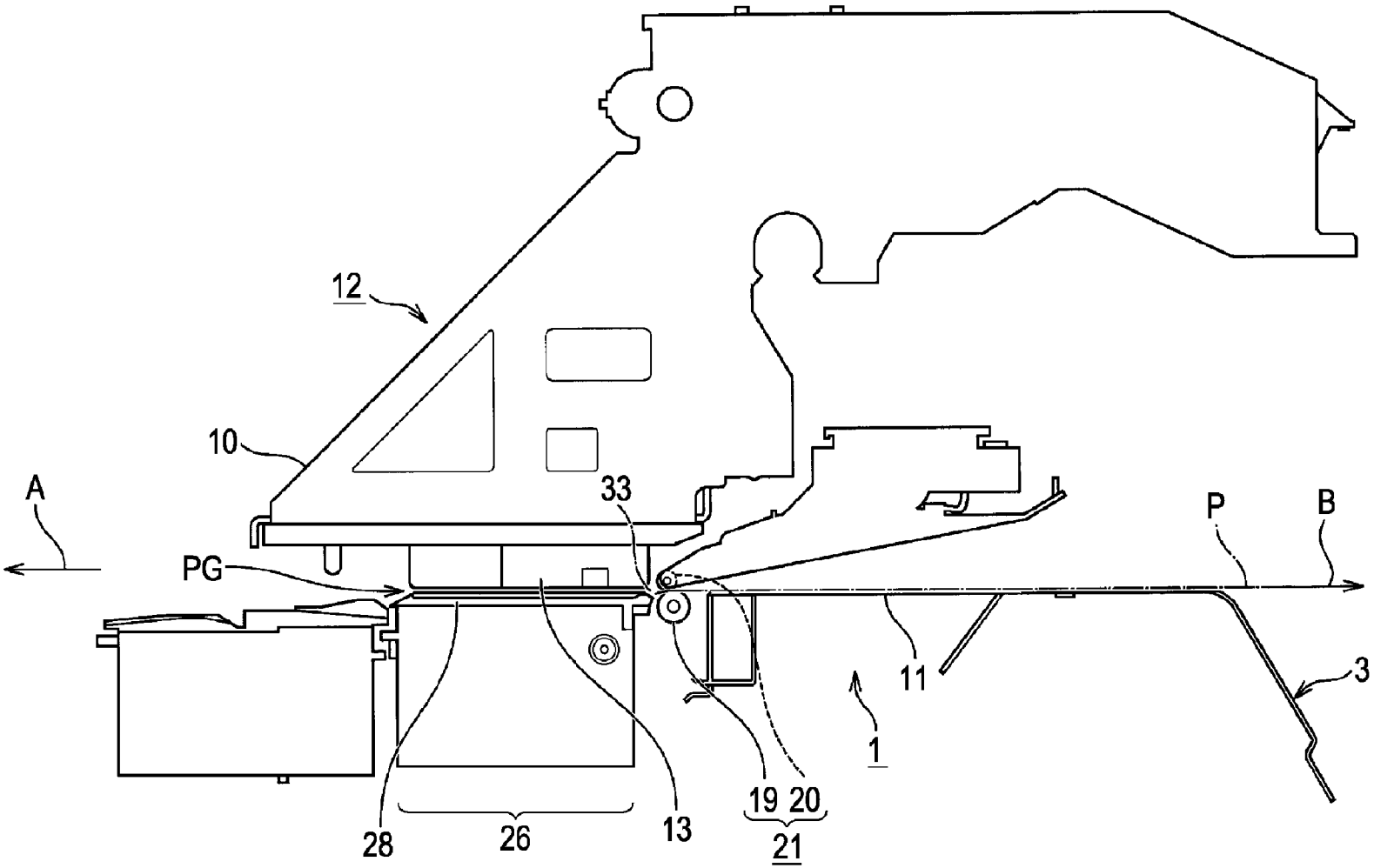
FIG. 3 is a side cross-sectional view schematically illustrating the internal structure of the ink jet printer.

FIG. 1 is a perspective view illustrating the outward appearance of the ink jet printer having a body cover attached thereto, and FIG. 2 is side cross-sectional view illustrating the ink jet printer from which the body cover is removed. FIG. 3 is a side cross-sectional view schematically illustrating the internal structure of the ink jet printer.

The ink jet printer 100 shown in FIGS. 1 to 3 includes a printer body 3, which is an example of a recording apparatus body. As shown in FIG. 1, the printer body 3 is covered with a body cover 2. A roll holder H that holds a roll sheet P in the horizontal direction is provided on the rear upper side of the printer body 3. A pair of left and right spindles 4R and 4L are provided in the roll holder H, and the roll sheet P held by roll retainers 5R and 5L including a pair of left and right flange portions 6R and 6L can be rotated integrally with the spindles 4R and 4L. In addition, a cartridge holder 8 having a plurality of cartridge slots capable of individually accommodating color ink cartridges is provided at, for example, the left end of the front surface of the printer body 3.

A control panel 9 for inputting various operation instructions is provided at, for example, the right end of the front surface of the ink jet printer 100. In addition, a transport guide plate 11 is provided in the printer body 3 so as to be inclined downward at an angle of about 60°, and guides the roll sheet P that is held in the horizontal direction by the spindles 4R and 4L such that the roll sheet P can be transported to the front lower side, which is the drawing direction A of the roll sheet P. The printer body 3 includes a transport device 1 that transports the roll sheet P, which is a roll-shaped recording medium according to the invention, downward toward a recording position 26 while drawings out the roll sheet P, and a recording device 12 that ejects ink onto a recording surface of the roll sheet P transported to the recording position 26 to perform desired recording.

The recording device 12 is provided at an obliquely upward position with respect to the recording position 26, and includes a recording head 13 that ejects ink to perform recording and a carriage 10 that has the recording head 13 mounted thereon and is reciprocated in a roll width direction C, which is a scanning direction. A platen 28 that supports the rear surface of the roll sheet P to define a gap PG between the roll sheet and the recording head 13 is provided below the recording position 26.

Embodiments

Next, the transport device 1 for transporting a roll-shaped recording medium according to an embodiment of the invention that can be applied to the ink jet printer 100 having the above-mentioned structure will be described in detail with reference to the accompanying drawings.

Figure 4:
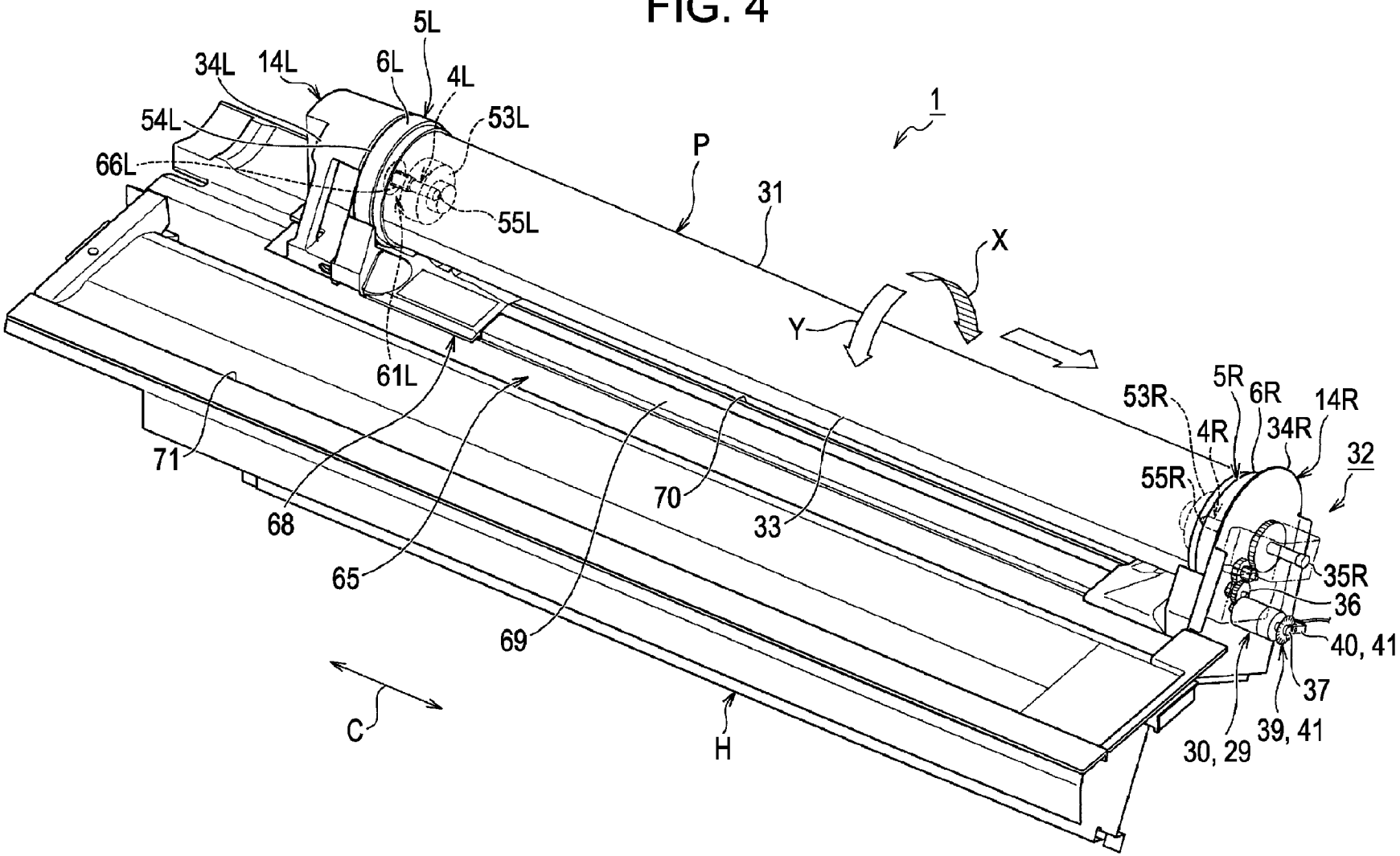
FIG. 4 is a perspective view illustrating a roll sheet that is set to a driving spindle.
Figure 5:
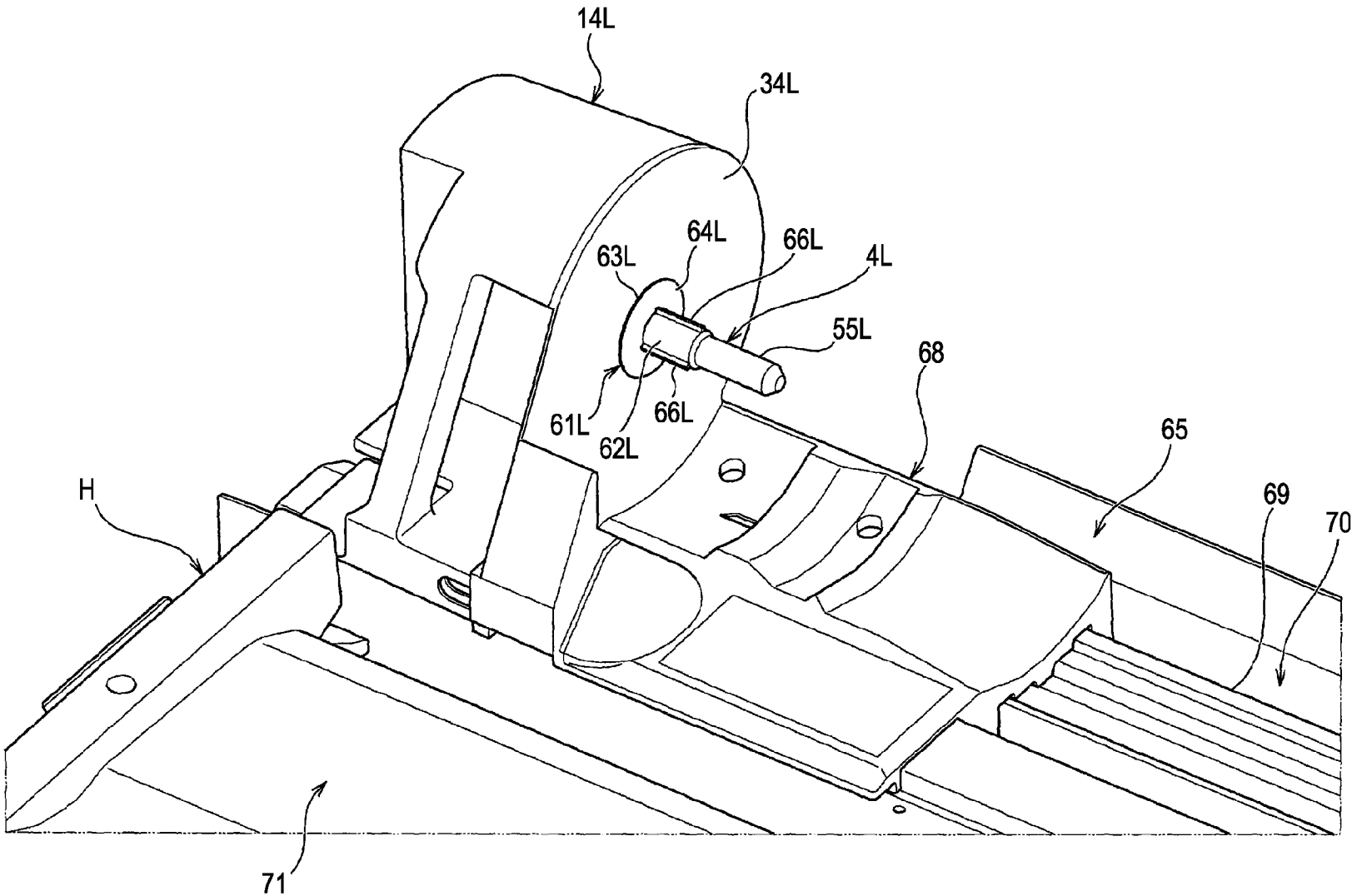
FIG. 5 is an enlarged perspective view illustrating the periphery of a driven spindle of a roll holder.
Figure 6:
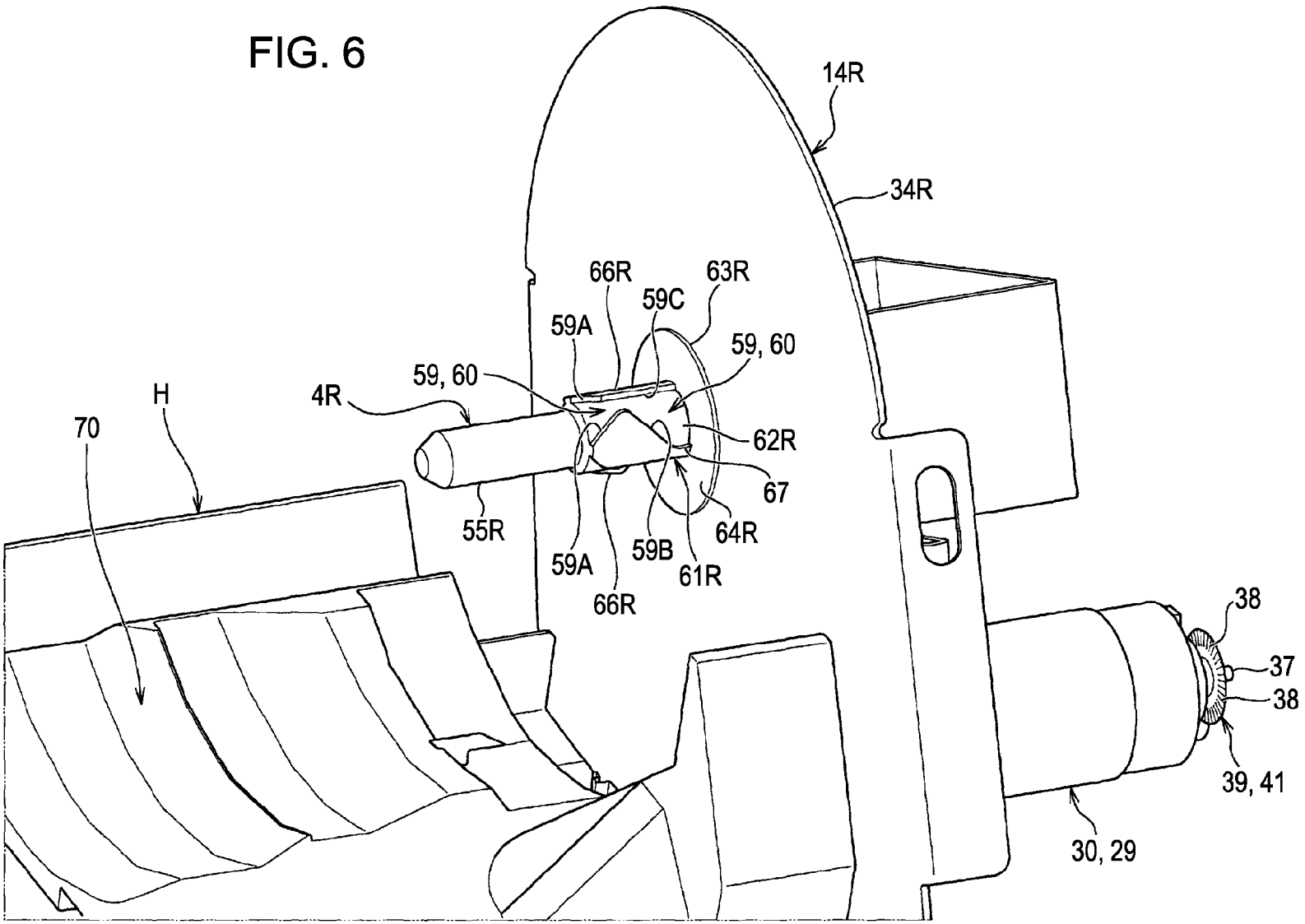
FIG. 6 is an enlarged perspective view illustrating the periphery of the driving spindle of the roll holder.
Figure 7:
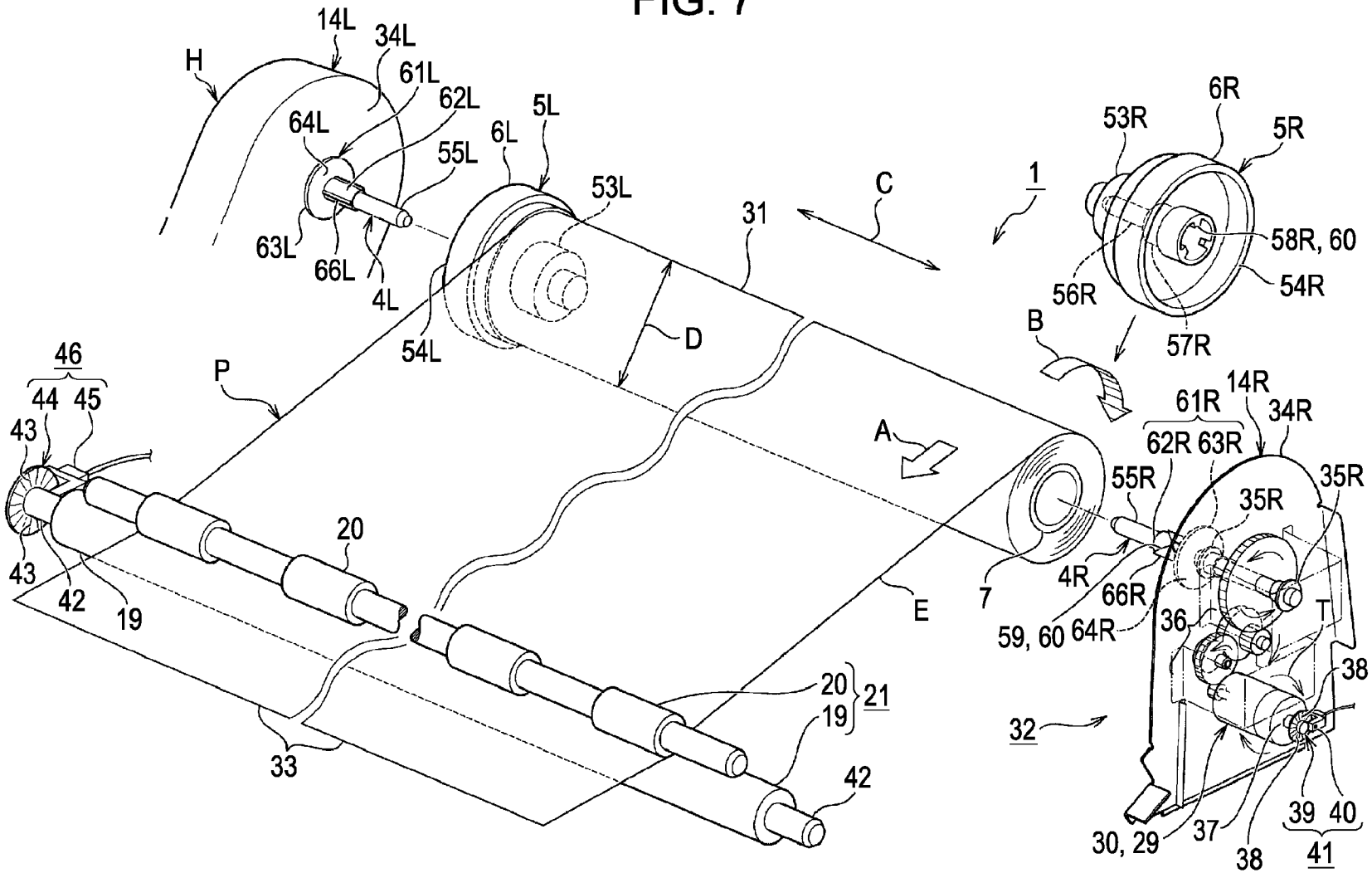
FIG. 7 is an exploded perspective view illustrating the roll sheet and a roll rewinding mechanism.
Figure 8:
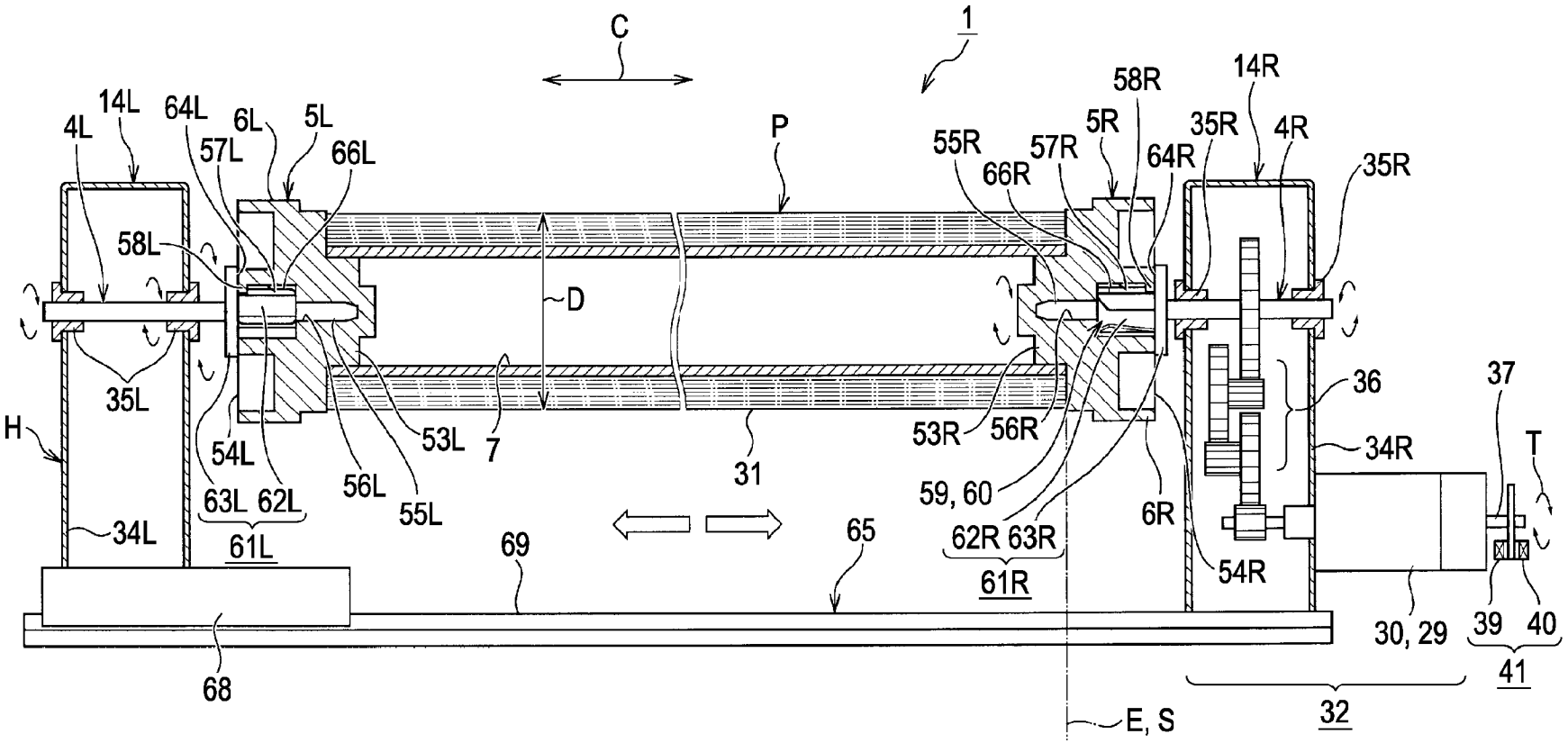
FIG. 8 is a front cross-sectional view illustrating a transport device for transporting a roll-shaped recording medium according to an embodiment of the invention.
Figure 9A:
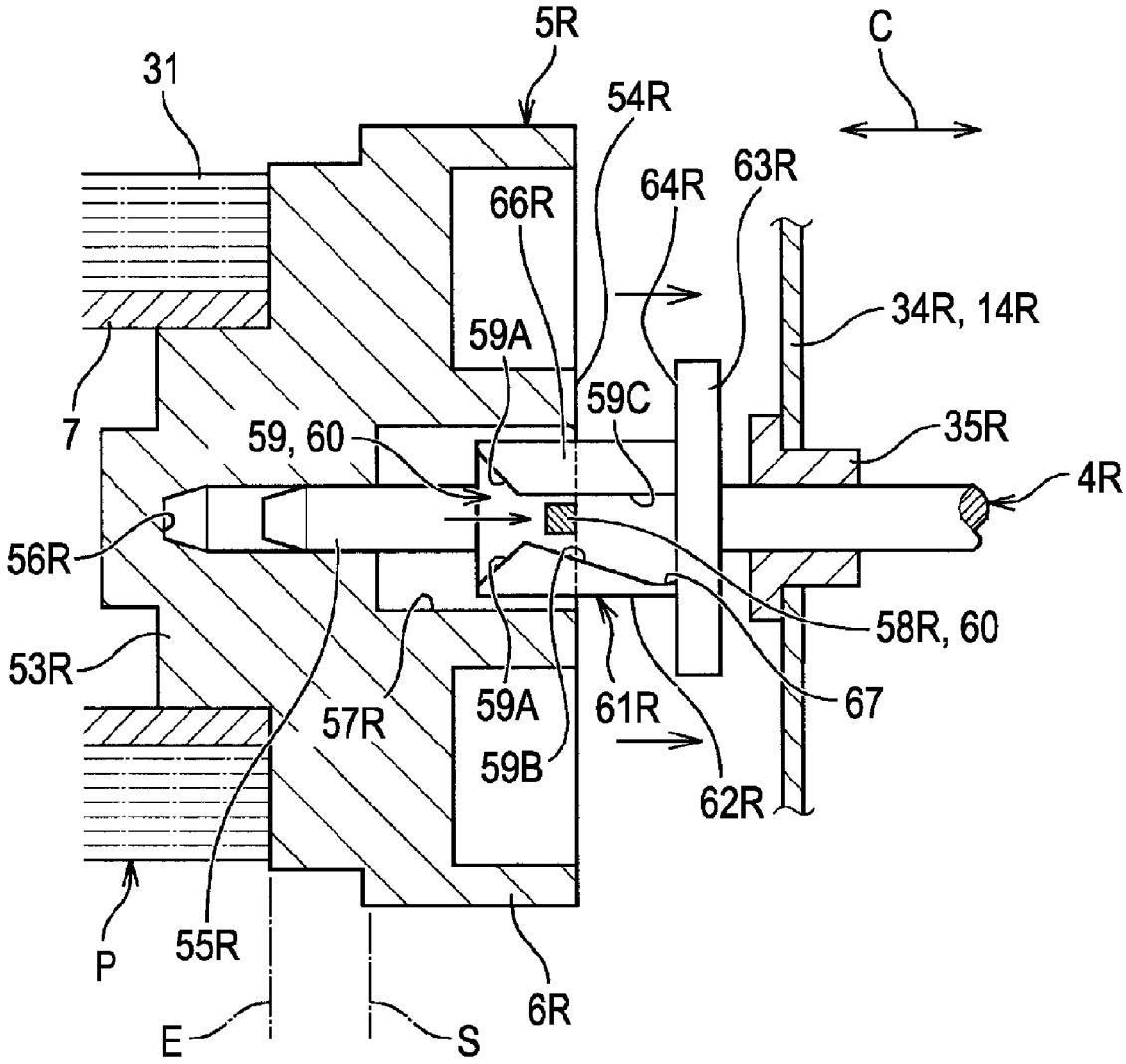
FIGS. 9A to 9C are front cross-sectional views sequentially illustrating the insertion or removal of the roll sheet into or from a driving side.
Figure 9B:
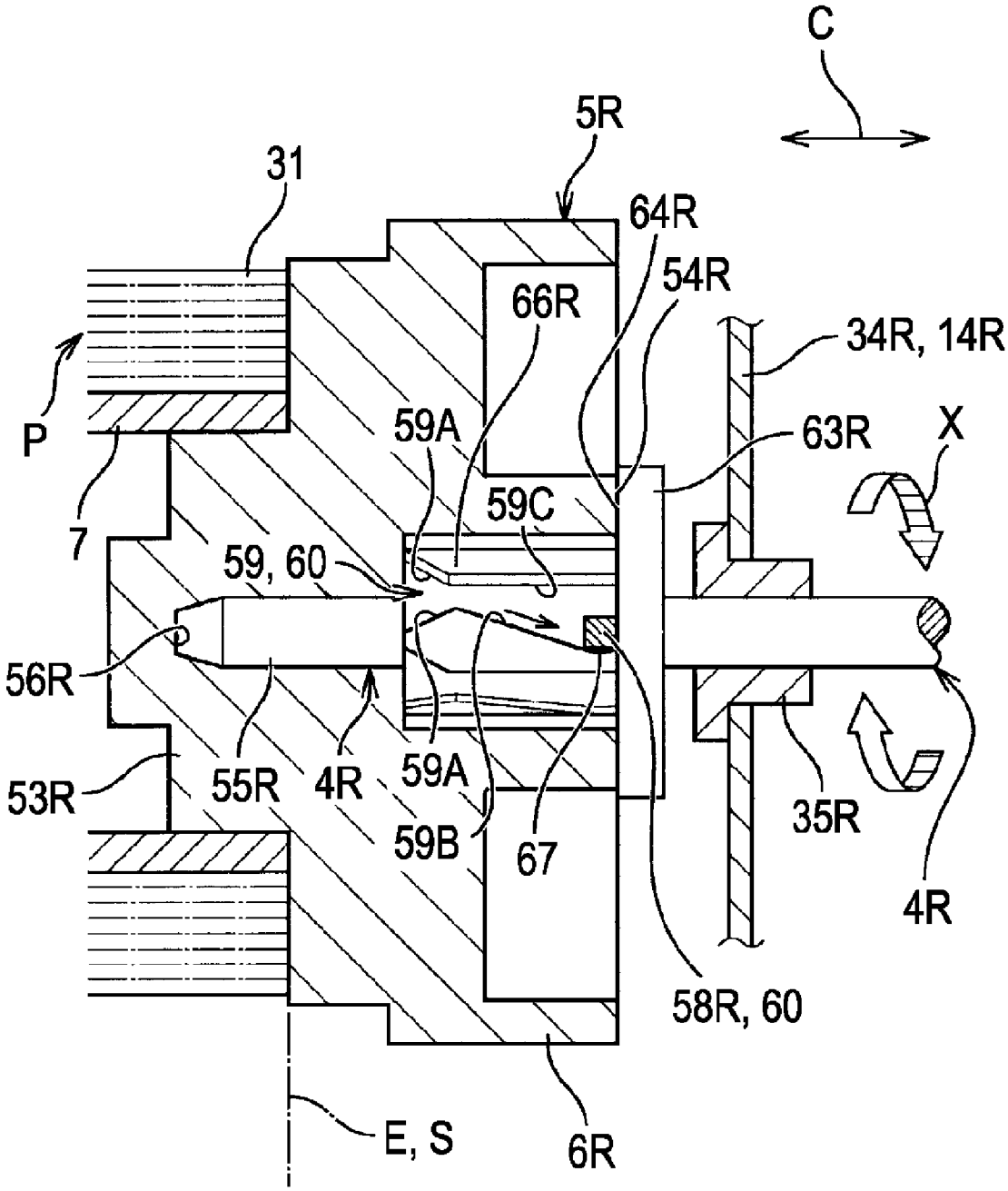
Figure 9C:
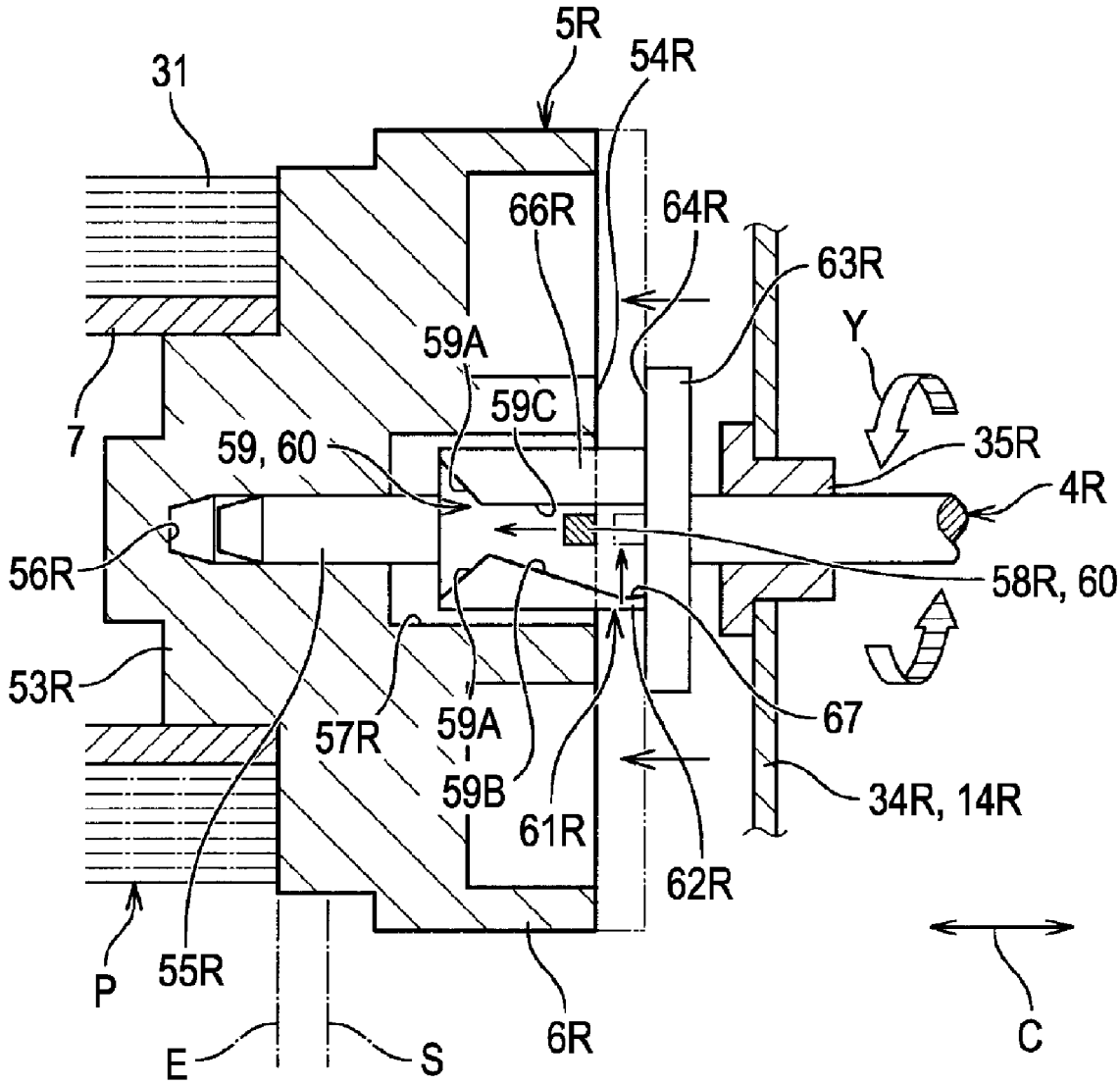
Figure 10:
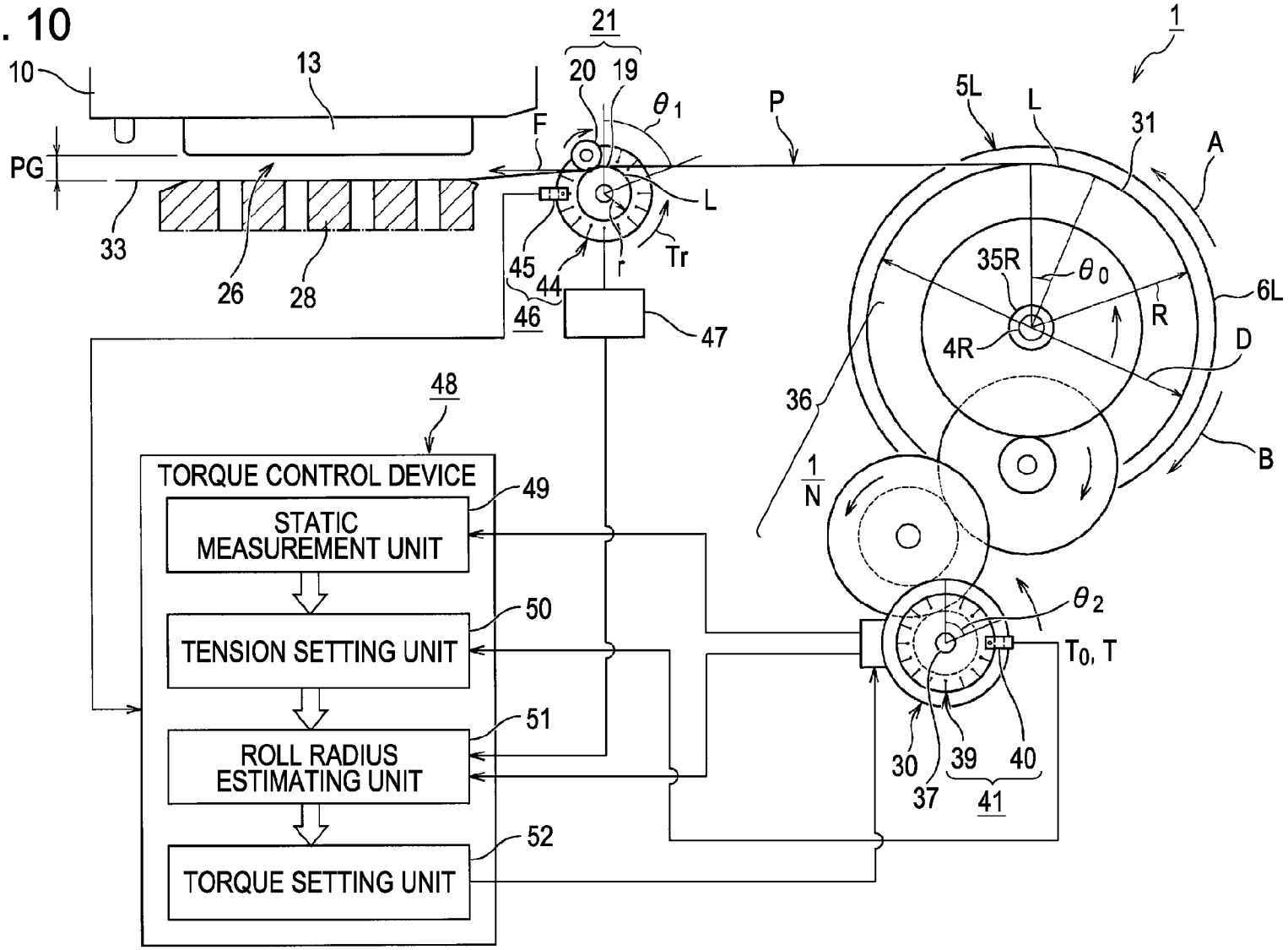
FIG. 10 is a side cross-sectional view illustrating the transport device for transporting a roll-shaped recording medium according to the embodiment of the invention.

FIG. 4 is a perspective view illustrating the roll sheet supported by a driving spindle and a driven spindle. FIG. 5 is an enlarged perspective view illustrating the periphery of the driven spindle of the roll holder. FIG. 6 is an enlarged perspective view illustrating the periphery of the driving spindle of the roll holder. FIG. 7 is an exploded perspective view illustrating the roll sheet and a roll rewinding mechanism. FIG. 8 is a longitudinal cross-sectional view illustrating the transport device that transports a roll-shaped recording medium according to the embodiment of the invention. FIGS. 9A to 9C are longitudinal cross-sectional views illustrating the insertion and removal of the roll sheet into or from the driving spindle. FIG. 10 is a diagram schematically illustrating the relationship between components of the transport device for transporting a roll-shaped recording medium according to the embodiment.

The transport device 1 for transporting a roll-shaped recording medium according to this embodiment basically includes: the driving roll retainer 5R and the driven roll retainer 5L that are attached to both sides of a roll portion 31 of the roll sheet P; the driving spindle 4R and the driven spindle 4L that are respectively engaged with the driving roll retainer 5R and the driven roll retainer 5L to support the roll portion 31; a driving supporting mechanism 14R and a driven supporting mechanism 14L that support the driving spindle 4R and the driven spindle 4L, respectively; a spindle motor 30 that rotates the driving spindle 4R forward and backward; and a moving mechanism 65 that moves the driven supporting mechanism 14L toward the driving supporting mechanism 14R such that the driving spindle 4R and the driven spindle 4L support the roll portion 31.

In this embodiment, the transport device 1 for transporting a roll-shaped recording medium further includes: a transport roller 21, which is a transport member for transporting the roll sheet P, including a transport driving roller 19 and a transport driven roller 20 that transport the roll sheet P drawn out from the roll portion 31 with the roll sheet interposed therebetween; and a tension generating member 29 that generates a constant tension F to the roll sheet P between the transport roller 21 and the roll portion 31 without being affected by the roll diameter D of the roll portion 31.

The transport device 1 for transporting a roll-shaped recording medium according to this embodiment is characterized in that it includes a positioning mechanism 60 that operates the transport roller 21 or the spindle motor 30 or drawing out the roll sheet P from the roll portion 31 to rotate the roll portion 31 supported by the driving spindle 4R and the driven spindle 4L in the direction in which tension is applied to the drawn roll sheet P, thereby moving the roll portion 31 to the driving spindle 4R such that the reference edge E of the roll sheet P comes into contact with a pressing reference position 64R. In this way, the positioning mechanism 60 positions the reference edge of the roll sheet.

The transport device 1 further includes: engaging portions 61R and 61L that are provided in the driving spindle 4R and the driven spindle 4L, respectively; and engaged portions 57R and 57L that are respectively provided in the driving roll retainer 5R and the driven roll retainer 5L and are respectively engaged with the engaging portions 61R and 61L of the spindles 4R and 4L such that power can be transmitted. The positioning mechanism 60 may be a cam structure 60 (which has the same reference numeral as the positioning mechanism 60) that is provided between the engaged portion 57R of the driving roll retainer 5R and the engaging portion 61R of the driving spindle 4R.

The driving roll retainer 5R and the driven roll retainer 5L include core portions 53R and 53L that are inserted into a roll core 7 of the roll sheet P and the flange portions 6R and 6L that come into contact with both end surfaces of the roll sheet P to hold the roll sheet P, respectively. The core portions and the flange portions are integrally formed. Small-diameter insertion grooves 56R and 56L into which the leading ends 55R and 55L of the spindles 4R and 4L are inserted and large-diameter engaged portions 57R and 57L that communicate with the insertion grooves 56R and 56L are formed at the centers of the outer end surfaces 54R and 54L of the roll retainers 5R and 5L provided in the flange portions 6R and 6L, respectively.

For example, three engaging protrusions 58R and three engaging protrusions 58L are provided at the same pitch on the inner circumferential surfaces of the engaged portions 57R and 57L so as to protrude inward. The driving engaging protrusions 58R also serve as cam followers 58R (which have the same reference numeral as the engaging protrusions 58R).

The spindles 4R and 4L are long round bars made of a metal material, and a tapering process is performed on the leading ends 55R and 55L such that the leading ends are easily inserted into the insertion grooves 56R and 56L. In addition, the engaging portions 61R and 61L are provided integrally with the leading ends 55R and 55L on the rear side of the leading ends 55R and 55L, and are engaged with the engaged portions 57R and 57L, respectively, such that driving power is transmitted to the roll portion 31. The engaging portions 61R and 61L include base portions 62R and 62L and flange portions 63R and 63L that come into contact with the outer end surfaces 54R and 54L of the roll retainers 5R and 5L, respectively. The base portions and the flange portions are integrally formed. The engaging portions 61R and 61L are rotated integrally with the spindles 4R and 4L, respectively.

The inner walls of the flange portions 63R and 63L that come into contact with the outer end surfaces 54R and 54L of the roll retainers 5R and 5L are defined as pressing reference surfaces 64R and 64L, respectively.

For example, three engaging ribs 66L that extend in the axial direction and are engaged with the engaging protrusions 58L of the driven roll retainer 5L are provided on the outer circumferential surface of the base portion 62L of the engaging portion 61L of the driven spindle 4L at the same pitch as that at which the engaging protrusions 58L are arranged. Three cam grooves 59 that are engaged with the cam followers 58R, serving as the engaging protrusions 58R, of the driving roll retainer 5R are formed on the outer circumferential surface of the base portion 62R of the driving engaging portion 61R at the same pitch as that at which the cam followers 58R are arranged. The other portions of the driving base portion 62R where the cam groove 59 is not formed serve as engaging convex portions 66R that are engaged with the engaging protrusions 58R.

The positioning mechanism 60 uses the moving mechanism 65 to support the roll sheet P with the spindles 4R and 4L, and rotates the roll portion 31 of the roll sheet P in a direction X in which tension is applied to the roll sheet P, thereby positioning the reference edge E of the roll sheet P. In this embodiment, the cam structure 60 (which has the same reference numeral as the positioning mechanism 60) is a cylindrical cam including the cam followers 58R and the cam grooves 59, and forms the positioning mechanism 60.

The cam groove 59 includes a guide portion 59A that guides the entrance of the cam follower 58R into the cam groove 59, a drawing part 59B that allows the cam follower 58R to be drawn into the cam groove 59 such that the reference edge E of the roll sheet P reaches the regular position S when the roll portion 31 is rotated in the direction X in which tension is applied to the roll sheet P, and a straight portion 59C that allows the cam follower 58R to be withdrawn from the cam groove 59 when the roll portion 31 is rotated in a Y direction in which tension is removed. The guide portion 59A includes two inclined planes having a shape that is tapered from one portion close to the leading end 55R of the driving spindle 4R to another portion close to the flange portion 63R.

The drawing portion 59B includes an inclined plane that is connected to the end of one of the two inclined planes that is positioned in the direction Y in which tension is removed and has a tapered shape that is inclined downward toward the flange portion 63R. In addition, a holding portion 67 that holds the cam follower 58R at a set position is formed at the end of the drawing portion 59B close to the flange portion 63R. The straight portion 59C includes a horizontal plane that is connected to the end of the other of the two inclined planes that is positioned in the direction X in which tension is applied and extends to the flange portion 63R.

The spindle motor 30 is composed of a tension generating member 29 that generates a constant tension F to the roll sheet P between the transport roller 21 and the roll portion 31. The set tension F of the roll sheet P is maintained at a constant value by controlling the set torque T of the spindle motor 30 to correspond to a variation in the roll diameter D or the roll radius R of the roll portion 31 of the roll sheet P. The spindles 4R and 4L and the spindle motor 30 form a roll rewinding mechanism 32. The roll rewinding mechanism 32 is used to return the start point 33 of the roll sheet P drawn out in the drawing direction A during recording to the origin position, and applies tension to the roll sheet P between the transport roller 21 and the roll portion 31.

The roll rewinding mechanism 32 basically includes: the spindles 4R and 4L that are rotatably supported in the horizontal direction by the supporting mechanisms 14R and 14L, respectively; the spindle motor 30 that is provided below the driving supporting mechanism 14R positioned on the right side; and a gear train 36 that is provided between the driving spindle 4R and an output shaft of the spindle motor 30, reduces the rotational speed of the output shaft of the spindle motor 30, and transmits the rotary power to the driving spindle 4R.

The moving mechanism 65 includes a slider 68 that is provided below the driven supporting mechanism 14L integrally with the supporting mechanism 14L and a guide rail 69 that guides the movement of the slider 68 and extends in the roll width direction C. A holding portion 70 that holds the roll sheet P and an auxiliary concave portion 71 that facilitates the transport of the roll sheet P to the holding portion 70 are provided on the upper side and the front side of the guide rail 69, respectively. The driving and driven supporting mechanisms 14R and 14L include, for example, two bearings 35R and two bearings 35L that rotatably support the driving and driven spindles 4R and 4L, and supporting frames 34R and 34L that support the bearings 35R and 35L, respectively.

In this embodiment, a shaft 37 protrudes from the rear surface of the spindle motor 30 and is rotated integrally with the spindle motor 30. A disk-shaped detecting plate 39 having a plurality of slits 38 radially arranged at the same pitch is attached to the shaft 37, and a detector 40 that detects the rotation angle $\theta_2$ of the spindle motor 30 using the slits 38 is provided in the vicinity of the detecting plate 39 in a non-contact state. The detecting plate 39 and the detector 40 form a rotary encoder 41.

In addition, a disk-shaped detecting plate 44 having a plurality of slits 43 radially arranged at the same pitch is attached to a roll shaft 42 of the transport driving roller 19, and a detector 45 that detects the rotation angle $\theta_1$ of the transport driving roller 19 using the slits 43 is provided in the vicinity of the detecting plate 44 in a non-contact state. The detecting plate 44 and the detector 45 form a rotary encoder 46. In addition, a torque measuring unit 47 that measures the operation torque Tr of the transport driving roller 19 during a roll radius estimating process is provided in the vicinity of the transport driving roller 19.

The transport device 1 for transmitting a roll-shaped recording medium according to this embodiment further includes a torque control device 48 that controls the set torque T of the spindle motor 30 to correspond to a variation in the roll diameter D of the roll portion 31 such that a constant tension F is applied to the roll sheet P between the transport roller 21 and the roll portion 31, regardless of the variation in the roll diameter D of the roll portion 31.

The torque control device 48 includes: a static measurement unit 49 that measures the offset torque $T_0$ of the spindle motor 30 when a static load is applied; a tension setting unit 50 that sets the tension F of the roll sheet P on the basis of the operation torque Tr of the transport driving roller 19 and the roll radius r of the transport driving roller 19; a roll radius estimating unit 51 that estimates the roll radius R of the roll sheet P on the basis of the rotation angle $\theta_2$ of the spindle motor 30 and the rotation angle $\theta_1$ of the transport driving roller 19 respectively detected by the two rotary encoders 41 and 46, the roll radius r of the transport driving roller 19, and the reduction ratio 1/N of the gear train 36; and a torque setting unit 52 that sets the torque T of the spindle motor 30 such that the set tension F is maintained at a constant value, on the basis of the offset torque $T_0$ of the spindle motor 30 when a static load is applied, the tension F set by the tension setting unit 50, the roll radius R estimated by the roll radius estimating unit 51, and the reduction ratio 1/N of the gear train 36.

Next, (A) a method of inserting or removing a roll-shaped recording medium using the transport device 1 for transporting a roll-shaped recording medium and (B) a process of setting the torque of a spindle motor according to this embodiment will be described.

(A) Method of Inserting or Removing Roll-Shaped Recording Medium (1) Process of Supporting Roll Portion (see FIGS. 4 and 9A)

The moving mechanism 65 moves the driven supporting mechanism 14L, and the driven roll retainer 5L moves a set roll sheet P toward the driving spindle 4R to set the driving roll retainer 5R to the driving spindle 4R. Specifically, the driven supporting mechanism 14L is moved integrally with the slider 68 toward the driving spindle 4R along the guide rail 69 to insert the leading end 55R of the driving spindle 4R into the insertion groove 56R of the driving roll retainer 5R and insert the base portion 62R of the driving spindle holder 61R into the engaged portion 57R.

In this process, the outer end surface 54R of the driving roll retainer 5R may not necessarily come into contact with the pressing reference surface 64R that is formed on the flange portion 63R of the driving spindle holder 61R. As shown in FIG. 9A, the cam follower 58R inserted into the cam groove 59 is guided by the inclined planes of the guide portion 59A and passes through at least a connecting portion between the guide portion and the drawing portion 59B.

(2) Set Position Correcting Process (see FIG. 9B)

A set position correcting process moves the roll portion 31 of the roll sheet P in the direction X in which tension is applied to the roll sheet to correct the set position of the roll sheet P, and moves the reference edge E of the roll sheet P to a regular position S. Specifically, any of the following general operations is performed: an operation of supporting the roll sheet P with two spindles and drawing out the start point 33 of the roll sheet P from the roll portion 31; an operation of rotating the transport roller 21 to transport the roll sheet P in the drawing direction A during recording; and an operation of rotating the driving spindle 4R in a winding direction B in order to apply tension to the roll sheet P between the transport roller 21 and the roll portion 31 before recording.

During the general operations, the driving spindle 4R and the driving engaging portion 61R are certainly rotated in the direction X in which tension is applied. Then, as shown in FIG. 9B, the cam follower 58R is guided by the inclined plane of the drawing portion 59B and reaches the holding portion 67 that comes into contact with the pressing reference surface 64R of the flange portion 63R. When the cam follower 58R reaches the holding portion 67, the reference edge E of the roll sheet P is disposed at the regular position S.

(3) Set Position Releasing Process (see FIG. 9C)

A set position releasing process rotates the roll portion 31 of the roll sheet P in the direction Y in which tension is removed such that the roll sheet P maintained at the set position can be moved to a driven side. That is, when the cam follower 58R shown in FIG. 9B is held by the holding portion 67, the drawing portion 59B that is inclined upward prevents the cam follower 58R from being moved to the driven side. Therefore, as shown in FIG. 9C, the roll sheet P is rotated in the direction Y in which tension is removed. Then, the cam follower 58R is moved upward due to its appearance. In FIG. 9C, the cam follower comes into contact with the straight portion 59C that is positioned above the cam follower. In this state, the cam follower 58R can be guided by the straight portion 59C to be smoothly moved. Therefore, it is possible to easily release the position of the roll sheet P set at the driving side.

(B) Process of Setting Torque of Spindle Motor

Figure 11:
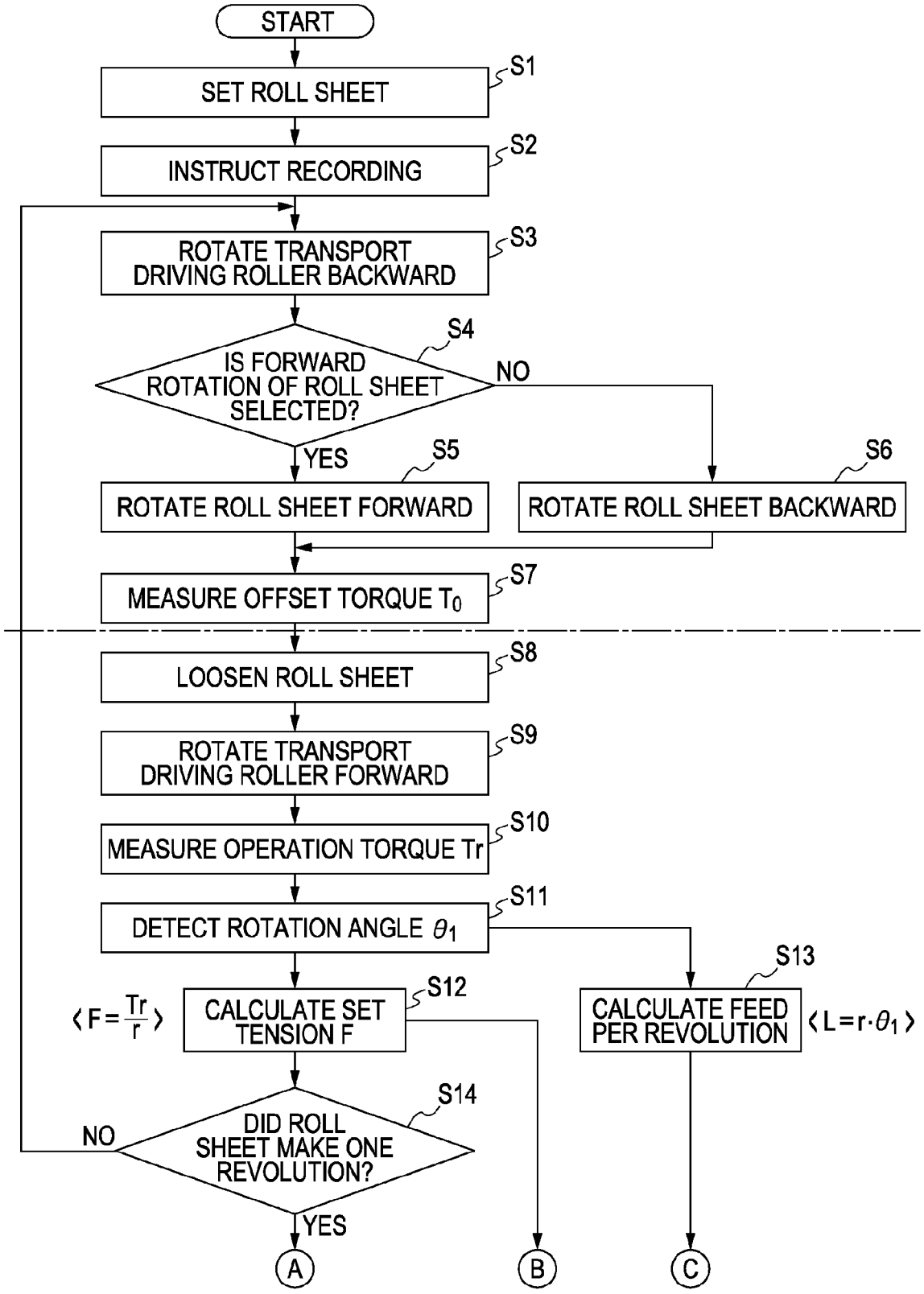
FIG. 11 is a flowchart illustrating the first half of a control process of setting the torque of a spindle motor.
Figure 12:
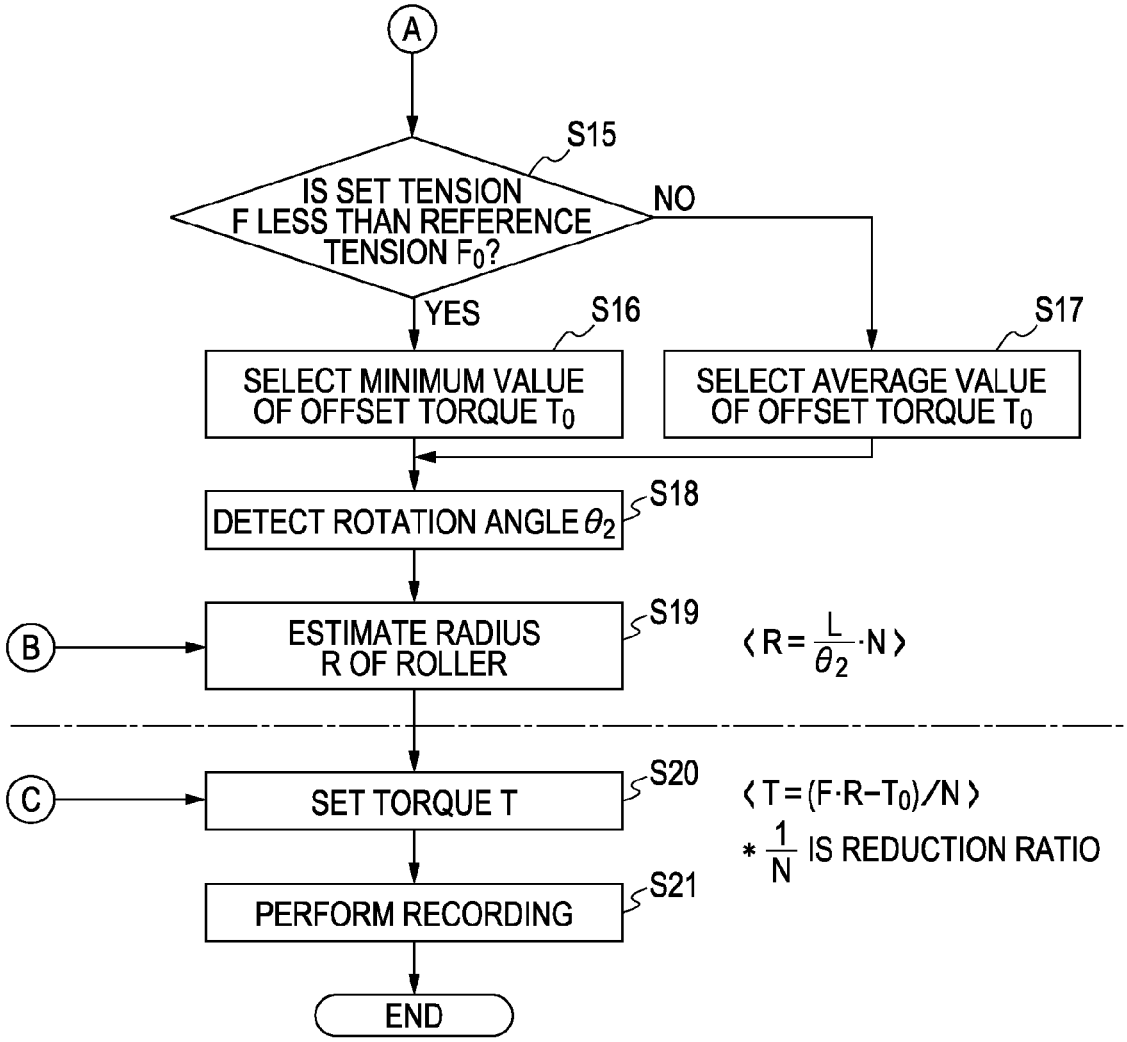
FIG. 12 is a flowchart illustrating the second half of the control process of setting the torque of the spindle motor.

FIG. 11 is a flowchart illustrating the first half of a control process of setting the torque of the spindle motor, and FIG. 12 is a flowchart illustrating the second half of the control process.

Next, the process of setting the torque of the spindle motor 30 is divided into four processes, such as (1) a static measurement process, (2) a tension setting process, (3) a roll radius estimating process, and (4) a torque setting process. The four processes will be described with reference to the flowcharts.

(1) Static Measurement Process (see FIG. 11)

A user sets the roll sheet P to the spindles 4R and 4L in Step S1. Specifically, the user attaches the roll retainers 5R and 5L to both sides of the roll sheet P, and sets the roll retainer 5L to the spindle 4L first. Then, the user moves the roll sheet P from the spindle 4L to the spindle 4R to set the roll retainer 5R to the spindle 4R. Then, in Step S2, the user performs a predetermined recording setting operation and issues a recording instruction.

Then, in Step S3, the transport driving roller 19 is rotated backward to loosen the roll sheet P between the transport roller 21 and the roll portion 31. Then, in Step S4, it is selected whether to rotate the roll sheet P forward to perform static measurement in the forward direction or to rotate the roll sheet P backward to perform static measurement in the backward direction. Basically, in Step S5, the roll sheet P is rotated forward, and in Step S7, the offset torque $T_0$ of the spindle motor 30 that is rotated forward when a static load is applied is measured.

When it is selected to perform static measurement in the backward direction, the roll sheet P is rotated backward in Step S6, and the offset torque $T_0$ of the spindle motor 30 that is rotated backward when a static load is applied is measured in Step S7. However, the offset torque $T_0$ is measured on the basis of a current value required to rotate the spindle motor 30 forward or backward.

(2) Tension Setting Process (see FIG. 11)

Then, in Step S8, the roll sheet P is loosened, and in Step S9, the transport driving roller 19 is rotated forward. Then, in Step S10, the operation torque Tr of the transport driving roller 19 is measured by the torque measuring unit 47, and in Step S11, the rotation angle $\theta_1$ of the transport driving roller 19 is measured by the rotary encoder 46. In Step S12, the set tension F is calculated from the relationship F=Tr/r on the basis of the measured operation torque Tr of the transport driving roller 19 and the known roll radius r.

In Step S13, a feed L per revolution is calculated from the relationship $L=r\cdot\theta_1$ on the basis of the detected rotation angle $\theta_1$ of the transport driving roller 19 and the known roll radius r. Then, in Step S14, it is determined whether the roll sheet P makes one revolution. If it is determined that the roll sheet makes one revolution, the next roll radius estimating process is performed. If it is determined that the roll sheet does not make one revolution, the process returns to Step S3 to repeatedly perform the measurement of the offset torque $T_0$ and the calculation of the set tension F and the feed L per revolution.

When the operation torque Tr of the transport driving roller 19 is constant, the tension setting process is omitted, and tension is appropriately selected from a table having tension data set for each sheet type and each sheet width.

(3) Roll Radius Estimating Process (see FIG. 12)

Then, in Step S15, it is determined whether the calculated set tension F is less than a predetermined reference tension $F_0$. If $F<F_0$, the minimum value of the measured offset torque $T_0$ is selected in Step S16. On the other hand, if $F\geqq F_0$, the average value of the measured offset torque $T_0$ is selected in Step S17. $F_0$ is a reference tension corresponding to the roll sheet P.

In Step S18, the rotation angle $\theta_2$ of the spindle motor 30 is detected by the rotary encoder 41. In Step S19, the roll radius R of the roll portion 31 is estimated from the relationship $R=(L/\theta_2)\cdot N$ on the basis of the feed L per revolution calculated in Step S13, the rotation angle $\theta_2$ of the spindle motor 30 detected in Step S18, and the known reduction ratio 1/N of the gear train 36.

(4) Torque Setting Process (see FIG. 12)

Then, in Step S20, the torque T of the spindle motor 30 is set from the relationship $T=(F\cdot R-T_0)/N$ on the basis of the offset torque $T_0$ measured in Step S7, the set tension F calculated in Step S12, the roll radius R estimated in Step S19, and the known reduction ratio 1/N. In Step S21, recording is performed by a constant tension F caused by the set torque T, without being affected by a variation in the roll diameter D.

Other Embodiments

The transport device 1 for transporting a roll-shaped recording medium and the recording apparatus 100 including the transport device 1 for transporting a roll-shaped recording medium according to this embodiment of the invention have the above-mentioned structure as the basic structure, and the structure may be partially changed or omitted without departing from the scope and spirit of the invention.

For example, the positioning mechanism is not limited to the cam structure 60 according to the above-described embodiment, but a screw structure that uses a nut as the engaged portion 57R of the driving roll retainer 5R and a bolt as the driving spindle holder 61R may be used as the positioning mechanism. In addition, the shape of the cam groove 59 is not limited to the above-described embodiment, but the cam groove 59 may have various shapes as long as it can obtain the same operations and effects as described above. The cam follower 58R may be provided in the spindle holder 61R, and the cam groove 59 may be formed in the roll retainer 5R.

Further, the tension generating member 29 is not limited to the spindle motor 30, but it may be other electromotive motors, or an electromagnetic clutch or brake. The output shaft of the spindle motor 30 may be directly connected to the driving spindle 4R without the gear train interposed therebetween as long as the spindle motor 30 can be rotated at a low speed.

What is claimed is:

1. A transport device for transporting a roll-shaped recording medium, comprising:

a pair of roll retainers that are attached to both sides of a roll portion of the roll-shaped recording medium;

a pair of spindles that are engaged with the roll retainers to support the roll portion;

a transport roller that transports the roll-shaped recording medium drawn out from the roll portion while pinching the roll-shaped recording medium; and a positioning mechanism that includes a drawing portion which rotates the roll portion supported by the spindles and draws the roll portion towards the spindles such that a reference edge on the side of the roll-shaped recording medium comes into contact with a reference position on the spindle, thereby positioning the reference edge of the roll-shaped recording medium.

2. The transport device for transporting a roll-shaped recording medium according to claim 1, further comprising:

a tension generating unit that generates a constant tension to the roll-shaped recording medium between the transport roller and the roll portion, regardless of a variation in the roll diameter of the roll portion.

3. A recording apparatus comprising:

the roll-shaped recording medium transport device according to claim 1 that transports a roll-shaped recording medium to a recording position while drawing out the roll-shaped recording medium; and a recording device that ejects ink onto a recording surface of the roll-shaped recording medium transported to the recording position to perform desired recording.

4. A transport device for transporting a roll-shaped recording medium, comprising:

a driving roll retainer and a driven roll retainer that are attached to both sides of a roll portion of the roll-shaped recording medium;

a driving spindle and a driven spindle that are engaged with the driving roll retainer and the driven roll retainer to support the roll portion;

a driving supporting mechanism and a driven supporting mechanism that support the driving spindle and the driven spindle;

a spindle driving source that rotates the driving spindle forward and backward;

a moving mechanism that moves the driven supporting mechanism toward the driving supporting mechanism such that the driving spindle and the driven spindle support the roll portion;

a transport roller that transports the roll-shaped recording medium drawn out from the roll portion while pinching the roll-shaped recording medium; and a positioning mechanism drawing the roll portion toward the driving spindle and the driven spindle that positions a reference edge of the roll-shaped recording medium by operating the transport roller or the spindle driving source or drawing out the roll-shaped recording medium from the roll portion to rotate the roll portion supported by the driving spindle and the driven spindle, the drawing portion thereby moving and drawing the roll portion toward the driving spindle such that the reference edge on the side of the roll-shaped recording medium comes into contact with a reference position on the driving spindle.

5. The transport device for transporting a roll-shaped recording medium according to claim 4, further comprising:

engaging portions that are provided in the driving spindle and the driven spindle; and engaged portions that are provided in the driving roll retainer and the driven roll retainer and are engaged with the engaging portions of the driving and driven spindles such that power can be transmitted, wherein the positioning mechanism is a cam structure that is provided between the engaged portion of the driving roll retainer and the engaging portion of the driving spindle.

6. The transport device for transporting a roll-shaped recording medium according to claim 5, wherein the cam structure has a cam including a cam follower that is formed on an inner circumferential surface of the driving roll retainer so as to extend inward and a cam groove that is formed in an outer circumferential surface of the engaging portion, and the cam groove includes:

a guide portion that guides the cam follower into the cam groove;

a drawing portion that draws the cam follower into the cam groove such that the reference edge of the roll-shaped recording medium reaches the reference position when the roll portion is rotated in the direction in which tension is applied; and a straight portion that enables the cam follower to be withdrawn from the cam groove when the roll portion is rotated in a direction in which the tension is removed.

* * * * *